US005372533A

United States Patent [19]

Sujack

[11] Patent Number: 5,372,533

[45] Date of Patent: Dec. 13, 1994

[54] ARTIFICIAL CAKE TOY AND METHOD OF MANUFACTURING SAME

[76] Inventor: Margaret A. Sujack, 396 Poplar Ave, Elmhurst, Ill. 60126

[21] Appl. No.: 131,087

[22] Filed: Oct. 1, 1993

[51] Int. Cl.[5] ..... A63H 33/30

[52] U.S. Cl. ..... 446/85; 446/488

[58] Field of Search ..... 446/1, 85, 86, 491, 446/481, 488, 489; 40/538; 434/81, 127, 365

[56] References Cited

U.S. PATENT DOCUMENTS 1,490,409 4/1924 Ventresca ..... 446/85
3,996,675 12/1976 Placek .
5,242,308 9/1993 Estrada ..... 446/365

*Primary Examiner*—Robert A. Hafer
*Assistant Examiner*—Jeffrey D. Carlson
*Attorney, Agent, or Firm*—Charles F. Meroni, Jr.

[57] ABSTRACT

An artificial cake toy and method of manufacturing same having a creative, artistic and recreational function for both children and adults. The cake toy contemplates the exercise of creative expression by the user through the use of artistic decorative effect. My method also provides a reusable mode of play in which a series of pieces of colored paper are placed upon a centerpiece which is mounted in integral assembly with a decorative tray. The centerpiece has a upper portion having a plurality of perforations or holes capable of receiving decorative pieces. The user manually places a layer of preselected colored paper upon the centerpiece and molds the paper to the form of the centerpiece by means of a cake press. Once molded to the form of the centerpiece, the colored paper is fixedly secured to the centerpiece by means of a circular frosting ring which is also mounted to the support tray. The user may then exercise their own artistic creativity by selecting from a plurality of decorative pieces each having a stem and inserting them through the colored paper overlying the plurality of perforations or holes located on the upper portion or face of the centerpiece thus securing the stems of the decorative pieces in the perforations or holes of the upper portion or face of the centerpiece. The user may then add further types of decorative effects to the colored paper in the form of words, drawings, designs, or the like.

23 Claims, 3 Drawing Sheets

ARTIFICIAL CAKE TOY AND METHOD OF MANUFACTURING SAME

FIELD OF THE INVENTION

The present invention relates to an artificial or simulated decorative cake toy and, more particularly, to an instructive reusable method of making an artificial decorative cake toy which promotes the creative exercise of manual dexterity and color comprehension of the user. The method of manufacture further comprehends the assembly and disassembly of an artificial cake for use in a variety of decorative designs, colors, and special occasions.

BACKGROUND OF THE INVENTION

Many young children experience a sense of heightened expectation and excitement at the approach of their annual birthday. The child's birthday is often celebrated by a traditional birthday party in which a number of relatives, family friends, and school classmates of the child gather together in a festive atmosphere. In the days immediately preceding the child's birthday, the child is often engaged in joyous preparation for the party. One of the highlights of a traditional birthday party is the serving of a ceremonial comestible birthday cake whereupon the child makes a wish as he or she extinguishes a number of candles corresponding to the child's age. The act of blowing out the candles is often accompanied by the singing of "Happy Birthday" by the party guests. This experience is often a cherished childhood memory for the child as a rite of passage in that they have been singled out for special recognition and attention by both their family and peers.

There are a number of prior art devices which relate to the general idea of an artificial cake. For example, U.S. Pat. No. 3,996,675 by Placek relates to an Instructional Birthday Cake Toy utilizing a large number of pieces and parts and addresses the instructional and educational aspects of a simulated cake. However, many of these prior art devices employ a burdensome number of pieces which can become confusing for a young child to assemble, thus frustrating the child and detracting from the playful experience. In addition, many prior an devices focus on the instructional aspect of assembling the cake and therefore do not promote or emphasize the aristic creativity the child can cultivate and develop by decorating the cake once it is assembled.

The present invention abrogates all of the drawbacks found in the prior an and seeks to provide an artificial or simulated non-comestible decorative cake toy in which a child or group of children can essentially recreate the joyful birthday experience in a creative, instructive, and playful manner. The present invention also provides creative avenues to cultivate and develop a child's manual dexterity skills, color comprehension, and artistic creativity while also allowing the child to decorate the cake toy in a personalized manner appropriate to an occasion selected by the child. In doing so, the child can relive a past pleasant birthday experience, practice making wishes for a future birthday, or playfully celebrate any type of other occasion. These experiences can further serve to develop social interaction skills in a playful environment and impart proper table manners. Further, the present invention is reusable in that once the simulated decorative cake toy is assembled and decorated, it can be disassembled for future use by another or the same child, thus maintaining the child's level of interest in the cake toy. Also, a series of children can make a succession of artificial cakes, one after the other as hereafter further described.

In addition, it is contemplated that the present invention is also applicable for use by an engaged couple when selecting the design of a wedding cake. Many betrothed couples wish to meticulously plan their wedding with a pre-selected theme. Oftentimes, the chosen theme may depart from the traditional wedding cake design and be completely personal to the couple. The present invention can thus allow an engaged couple to individually create a simulated decorative cake corresponding to their personally chosen design. The couple could then show the artificial decorative cake of the present invention to a baker who could then be hired to reproduce the design created by the couple in comestible cake form.

SUMMARY OF THE INVENTION

The artificial decorative cake toy of the present invention includes a support tray or plate which is further defined by a decorative border extending around the outside circumference of the tray or plate. The improvement being a centerpiece having a peripheral shape smaller than the support tray which is mounted upon the tray in an axially centered relationship. The centerpiece has a lower portion and an upper portion wherein the lower portion of the centerpiece is fixedly mounted to the support tray in mounted integral assembly. The upper portion of the centerpiece has a plurality of holes. One of a series of pieces of colored paper is placed in mounted engagement on the upper portion of the centerpiece such that the colored paper is mounted over the plurality of holes and with portions of the colored paper being of sufficient size to engage the tray. Forming means are provided to mold and anchor the colored paper to the centerpiece comprising a cake cover which is manually placed over one of a series of pieces of colored paper so that the paper is molded to the form of the centerpiece by the cake cover. Once the paper is molded to the form of the centerpiece, the cake cover is manually removed and an annular frosting ring is placed over the colored paper and the centerpiece to anchor and secure the paper to the centerpiece. Both the cake cover and the annular frosting ring have a diameter slightly larger than the centerpiece to facilitate manual placement over the centerpiece. The frosting ring is placed over the colored paper and the centerpiece and mounted against the support tray thereby securing and forming the colored paper to the centerpiece. A plurality of decorative pieces each having a stem sized for telescoping insertion into the plurality of holes on the upper portion of the centerpiece are provided. The stems of the decorative pieces are inserted through the colored paper overlying the holes and are retainingly secured in the holes. It is contemplated that the components of my invention, in particular the centerpiece and the tray, be constructed of a lightweight stiff plastic such as polyethylene or polypropylene suitable for heat sealing or a metal such as aluminum to give the invention the overall appearance of conventional cake baking materials.

My invention further contemplates a method of manufacture of an artificial decorative cake toy including the steps of providing a circular-shaped support tray having a decorative border extending around the perimeter of the tray. Locating a peripheral-shaped centerpiece having a diameter smaller than the tray in an axially centered position on the tray where the centerpiece has an upper portion and a lower portion. Mounting the lower portion of the centerpiece on the tray in mounted integral assembly therein. Forming a plurality of holes in the upper portion of the centerpiece. Placing one of a series of pieces of colored paper over the upper portion of the centerpiece so that the colored paper is in an axially centered position over said centerpiece. Manually lowering a peripheral-shaped cake press over both the colored paper and the centerpiece in a downwardly extending motion thereby molding and shaping the colored paper to the form of the centerpiece. Manually removing the cake press in an upwardly extending motion leaving the colored paper pressed and molded to the centerpiece. Manually placing a peripheral-shaped frosting ring over both the colored paper and the centerpiece thereby forming the colored paper against the centerpiece and mounting the frosting ring on the support tray thereby securing the colored paper to the centerpiece. Inserting a plurality of decorative pieces having a stem of corresponding diameter to the plurality of holes through the colored paper overlying the upper portion of the centerpiece such that the stems of the decorative pieces are mounted in the plurality of holes. The colored paper of the cake toy may then be decorated with a variety of decorative means.

It is further contemplated that the present invention can be disassembled for additional use by the same or another child by removing the decorative pieces from the perforations and manually lifting the frosting ring from the centerpiece, thus releasing the colored paper for removal. The colored paper could be saved by the child as a remembrance of his or her creative effort or discarded.

In light of the foregoing, it is the principal object of the invention to provide an artificial or simulated decorative cake toy for use by a child in which the child can recreate an enjoyable birthday experience or the like in a creative and playful manner.

A further object of the invention is to provide a method of making an artificial or simulated decorative cake toy in which the child can exercise artistic skills in decorating the cake with various colors, shapes, designs, letters, and/or words.

A still further object of the invention is to provide a child's toy which is both attractive and enjoyable to children, and which may be employed in a game or mode of play which seeks to recreate a pleasant experience or memory from a birthday or other special event.

Yet another object of the present invention is to provide a simulated decorative cake for engaged couples to create their own custom designed theme wedding cake which, if desired by the couple, could be replicated in comestible form by a baker.

Additional objects, advantages and features of the present invention will become apparent from the following description and appended claims, taken in conjunction with the accompanying drawings.

DETAILED DESCRIPTION OF THE INVENTION

Figure 5:
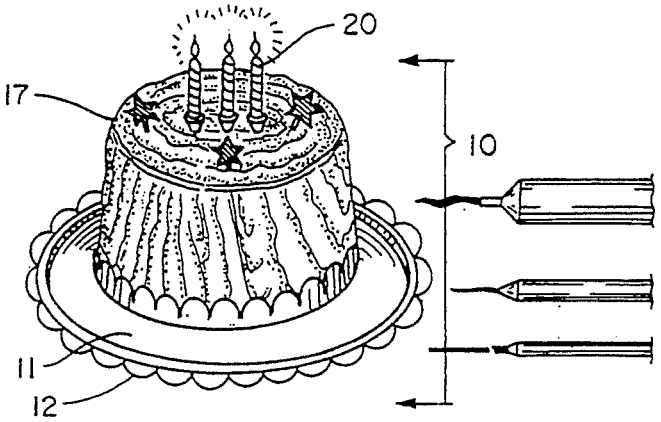
FIG. 5 is a perspective view of my invention in a fully decorated state wherein a number of decorative pieces have been inserted through the colored paper overlying the upper face of the centerpiece and into the perforations or holes.

The reference numeral 10 generally relates to my artificial or simulated decorative cake toy in its finished and decorated state. The cake toy 10 includes a circular-shaped support tray or plate 11 having a decoratively designed border 12 extending around the circumference of the tray 11. An inverted cup-shaped cake mold or centerpiece 13 having a diameter smaller than the tray 11 is mounted upon the tray 11 in an axially centered relationship. The tray 11 is similar in size and shape to a dinner plate and centerpiece is preferably attached as a one piece assembly to the tray 11 by glue or other suitable means or formed in one piece together, as desired. The centerpiece has a lower portion or face 14 and an upper portion or face 15. The portion face 14 is fixedly sealed to the tray 11 by a heat sealing means comprising a stiff plastic material such as polyethylene or polypropylene such that the tray 11 and the centerpiece are in mounted integral assembly therein. The upper portion of the centerpiece has a plurality of perforations or holes 16. A series of pieces or sheets of peripheral-shaped colored paper 17 are provided. Each paper 17 has a diameter greater than the centerpiece 13 so that the outside perimeter of the paper 17 completely overlies the centerpiece 13 thereby enhancing the visual effect of the artificial cake toy 10, however, the diameter of the paper 17 is smaller than the diameter of the tray 11 so that the paper 17 which most resembles a comestible cake appears to be centered in a decorative manner upon the tray 11 in a position that is visually pleasing and depicts an actual comestible cake placed on a serving tray. The paper 17 is mounted on the upper face 15 of the centerpiece 13 such that the colored paper 17 overlies the plurality of perforations or holes 16. An inverted cup-shaped cake cover or cake press 18 having a diameter slightly larger than the centerpiece 13 is manually lowered in a downwardly extending motion over both the colored paper 17 and the centerpiece 13 thereby molding and shaping the colored paper 17 to the form of the centerpiece 13. The cake press 18 is then manually removed in an upwardly extending motion leaving the colored paper 17 pressed to the form of the centerpiece 13. A peripheral-shaped frosting ring 19 having a diameter slightly larger than the centerpiece 13 is further provided and manually lowered over the now molded colored paper 17 and the centerpiece 13 in a downwardly extending motion until the frosting ring 19 is mounted snugly upon the support tray or plate 11, thus firmly securing the colored paper 17 to the centerpiece 13. A plurality of decorative pieces 20 each having a stem 21 of a corresponding diameter to the plurality of perforations or holes 16 found on the upper face 15 of the centerpiece 13 may then be manually inserted through the colored paper 17 overlying the upper face 15 and mounted into the perforations or holes 16 such that the stem 21 is mounted in each of the holes 16 and leaving the decorative piece 20 viewable by the user. As shown in FIG. 5, the user is then free to decorate the cake toy in any manner chosen by him or her using colored quick dry tube paint, crayons, felt tip marker pens, or the like.

Figure 1:
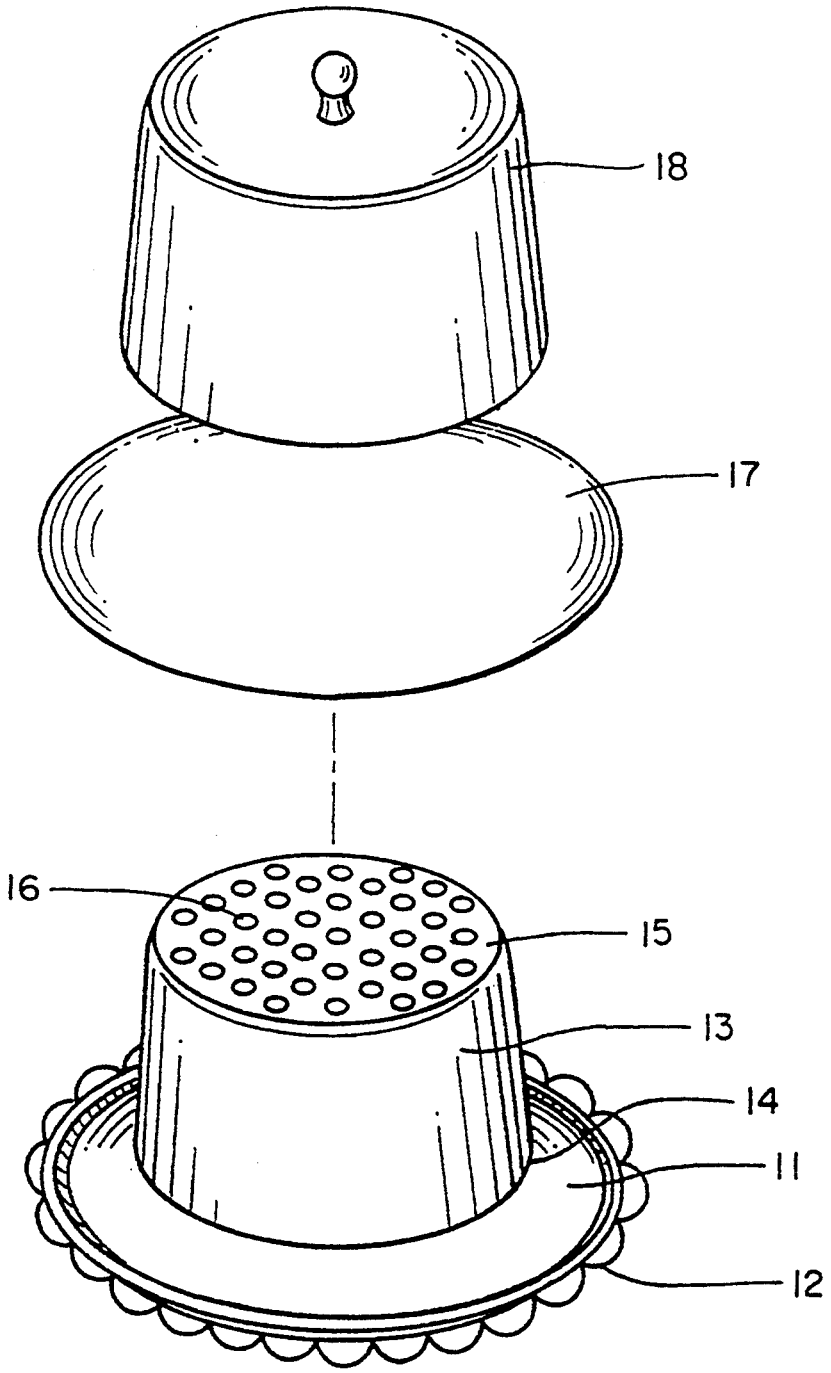
FIG. 1 shows an exploded component view of my invention before the circular-shaped colored paper is manually pressed upon the centerpiece and the upper face of the centerpiece having a plurality of perforations or holes by the circular-shaped cake cover.
Figure 2:
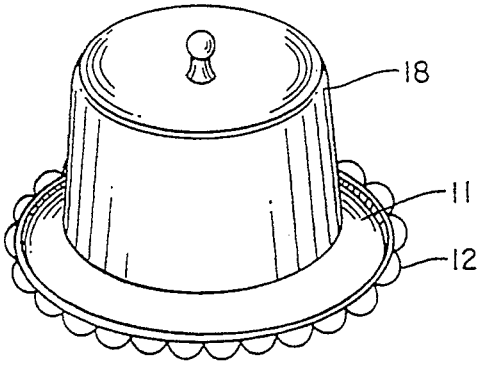
FIG. 2 is a perspective view of my invention depicting the stage wherein the cake cover has been manually lowered onto the colored paper and centerpiece in a downwardly extending motion thereby molding and forming the colored paper to the form of the centerpiece.
Figure 3:
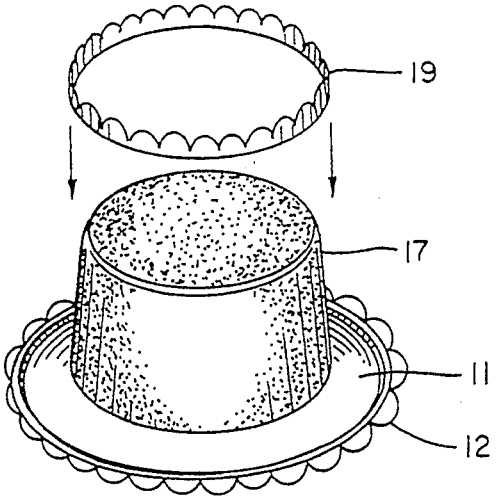
FIG. 3 is perspective component view of my invention wherein the circular-shaped cake cover has been previously manually removed in an upwardly extending motion and the circular-shaped frosting ring is now being manually lowered over both the colored paper and the centerpiece in a downwardly extending motion.
Figure 4:
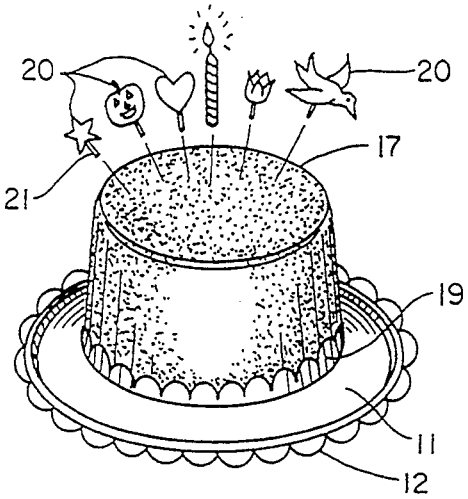
FIG. 4 is a perspective view of my invention showing the frosting ring mounted upon the support tray or plate thereby securing the colored paper to the form of the centerpiece.
Figure 6:
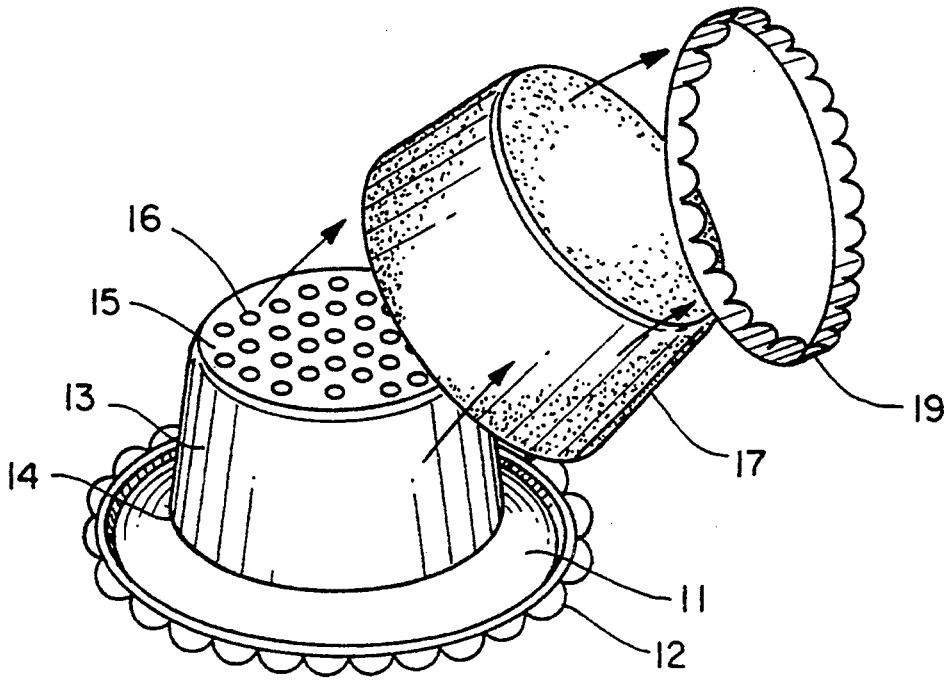
FIG. 6 is a perspective component view of my invention showing the process of disassembly wherein the frosting ring is manually removed in an upwardly extending motion thereby releasing the colored paper from overlying the centerpiece thus exposing the perforations or holes located on the upper face of the centerpiece.

The components and method of my invention can be further exemplified through the appended drawings. As shown in FIG. 1, the centerpiece 13 is mounted in centered integral assembly with the support tray 11 which also has a decorative border 12 extending around the perimeter of the tray 11. The centerpiece is further characterized by an upper portion 15 having a plurality of perforations or holes 16. A series of pieces of colored paper 17 are provided. These paper pieces are used on a one-at-a-time basis. One paper piece 17 is placed over the upper face 15 and is hand shaped or molded to the centerpiece 13 by a cake press. The cake press 18 is manually lowered over both the colored paper 17 and the centerpiece in a downwardly extending motion which functions also to shape the paper piece 17 over the center piece 13. As shown in FIG. 2, the cake press 18 is placed firmly over the centerpiece. FIG. 3 depicts my invention after the cake press 18 has been manually removed in an upwardly extending motion leaving the colored paper 17 formed and shaped to the centerpiece 13. A peripheral shaped frosting ring 19 is then manually lowered onto the formed and shaped colored paper 17 and the centerpiece 13 to fixedly secure the colored paper 17 to the centerpiece, as shown in FIG. 3 and FIG. 4. As also shown in FIG. 4, the frosting ring 19 is mounted to the support tray 11. FIG. 5 depicts my invention in its decorated form wherein a plurality of decorative pieces 20 have been inserted through the colored paper and into the plurality of perforations or holes 16 located on the upper face 15 of the centerpiece 13. As shown in FIG. 6, my invention can be disassembled for future use by manually removing the frosting ring 19 in an upwardly extending motion followed by the manual removal of the colored paper 17 in an upwardly extending motion. It is contemplated that my method and device can be played like a game where first one person decorates an artificial cake as described. The decorated cake is then removed from the centerpiece and a second person with a fresh piece of colored paper 17 will then be used by the second person to form and mold the paper and decorate a second artificial cake. Additional persons can follow doing the same thing until all participants have each made an artificial cake.

The foregoing discussion discloses and describes merely exemplary embodiments of the present invention. One skilled in the art will readily recognize from such discussion, and from the accompanying drawings and claims, that various changes, modifications, and variations can be made without departing from the spirit and scope of the invention as defined in the following claims.

I claim:

1. A method of manufacture of an artificial decorative cake toy including the steps of providing a circular-shaped support tray having a decorative border extending around the perimeter of said tray, locating a peripheral-shaped centerpiece having a diameter smaller than said tray in an axially centered position on said tray, providing said centerpiece having an upper portion and a lower portion, mounting said lower portion of said centerpiece on said tray in mounted integral assembly therein, forming a plurality of holes in said upper portion of said centerpiece, placing one of a group of pieces of colored paper over said centerpiece so that said colored paper is in an axially centered position over said centerpiece, manually lowering a peripheral-shaped cake press over both said colored paper and said centerpiece in a downwardly extending motion thereby molding and shaping said colored paper to the form of said centerpiece, manually removing said cake press in an upwardly extending motion leaving said colored paper pressed and molded to said centerpiece, manually placing a peripheral-shaped frosting ring over both said colored paper and said centerpiece thereby forming said colored paper against said centerpiece and mounting said frosting ring on said support tray thereby securing said colored paper to said centerpiece, inserting a plurality of decorative pieces having a stem of corresponding diameter to said plurality of holes through said colored paper overlying said upper portion of said centerpiece such that said stems of said plurality of decorative pieces are mounted in said plurality of holes, and decorating said colored paper with decorative means.

2. The method of manufacture of claim 1 including the steps of forming decorative symbols on said colored paper with colored crayons.

3. The method of manufacture of claim 1 including the steps of forming decorative symbols on said colored paper with colored quick dry tube paint.

4. The method of manufacture of claim 1 including the steps of disassembling said artificial cake toy by first manually removing said stems of said plurality of decorative pieces from said plurality of holes on said upper portion of said centerpiece in an upwardly extending motion, retaining said decorative pieces, and then manually removing said frosting ring from the mounted position on said support tray in an upwardly extending motion thereby freeing said colored paper from said centerpiece, retaining said frosting ring, manually removing said colored paper in an upwardly extending motion, and retaining said colored paper.

5. The method of manufacture of claim 4 including the steps of removing the piece of molded and decorated colored paper, and applying a fresh undecorated sheet to the centerpiece and repeating the steps as previously described.

6. A method of manufacture of an artificial decorative cake toy including the steps of providing a circular-shaped support tray having a decorative border extending around the perimeter of said tray, locating a peripheral-shaped centerpiece having a diameter smaller than said tray in an axially centered position on said tray, providing said centerpiece having an upper portion and a lower portion, mounting said lower portion of said centerpiece on said tray in mounted integral assembly therein, forming a plurality of holes in said upper portion of said centerpiece, placing a piece of colored paper over said centerpiece, manually lowering a peripheral-shaped cake press having a diameter slightly larger than said centerpiece over both said colored paper and said centerpiece in a downwardly extending motion thereby molding and shaping said colored paper to the form of said centerpiece, manually removing said cake press in an upwardly extending motion leaving said colored paper pressed and molded to said centerpiece, manually placing a peripheral-shaped frosting ring having a diameter slightly larger than said centerpiece over both said colored paper and said centerpiece thereby forming said colored paper against said centerpiece and mounting said frosting ring on said support tray thereby securing said colored paper to said centerpiece, inserting a plurality of decorative pieces having a stem of corresponding diameter to said plurality of holes through said colored paper overlying said upper portion of said centerpiece such that said stems of said plurality of decorative pieces are mounted in said plurality of holes, decorating said colored paper with decorative means, viewing said artificial decorative cake toy, disassembling said artificial decorative cake toy for use by another user by first manually removing said plurality of decorative pieces inserted in said holes on said upper portion of said centerpiece in an upwardly extending motion, manually removing said frosting ring from the mounted position on said support tray in an upwardly extending motion thereby freeing said colored paper from said centerpiece, and manually removing said colored paper in an upwardly extending motion.

7. In an artificial decorative cake toy having a support tray, the improvement of a centerpiece having a peripheral shape smaller than said tray and being mounted upon said tray in an axially centered relationship thereof, said centerpiece having a lower portion and an upper portion, securing means to fixedly mount said lower portion of said centerpiece on said support tray in mounted integral assembly therein, said upper portion of said centerpiece having a plurality of holes, one of a series of pieces of colored paper is mounted in engagement on said upper portion of said centerpiece such that said colored paper is mounted over said plurality of holes and with portions of said colored paper being of sufficient size to engage the tray, forming means comprising a cake cover having a diameter slightly larger than said centerpiece, said frosting ring placed over said centerpiece and said paper molding said colored paper to the form of said centerpiece, said forming means also comprising an annular frosting ring having a diameter slightly larger than said centerpiece, after said cake cover has been removed from said centerpiece, said frosting ring being positioned over said centerpiece and mounted against said support try thereby securing and anchoring said colored paper to said centerpiece, and a plurality of decorative pieces each having a stem sized for telescoping insertion into said holes on said upper portion of said centerpiece, said stems of said decorative pieces being inserted through said colored paper overlaying said holes and being retainingly secured in said holes.

8. The artificial decorative cake toy of claim 7 wherein said securing means used to fixedly mount said lower portion of said centerpiece to said support tray is comprised of a heat sealed polyethylene plastic.

9. The artificial decorative cake toy of claim 7 wherein said securing means used to fixedly mount said lower face of said centerpiece to said support tray is comprised of a heat sealed polypropylene plastic.

10. The artificial decorative cake toy of claim 7 wherein said piece of colored paper after being decorated being removable by lifting said frosting ring off said centerpiece and then after removing the decorated piece of colored paper, another piece of colored paper being applied to said centerpiece and secured by said frosting as previously described.

11. The artificial decorative cake toy of claim 7 wherein said support tray is circular-shaped and comprised of polyethylene.

12. The artificial decorative cake toy of claim 7 wherein said support tray is circular-shaped and comprised of polypropylene.

13. The artificial decorative cake toy of claim 7 wherein said support tray is circular-shaped and comprised of aluminum.

14. The artificial decorative cake toy of claim 7 wherein said centerpiece is circular-shaped and comprised of polyethylene.

15. The artificial decorative cake toy of claim 7 wherein said centerpiece is circular-shaped and comprised of polypropylene.

16. The artificial decorative cake toy of claim 7 wherein said centerpiece is circular-shaped and comprised of aluminum.

17. The artificial decorative cake toy of claim 7 wherein said frosting ring is circular-shaped and comprised of polyethylene.

18. The artificial decorative cake toy of claim 7 wherein said frosting ring is circular-shaped and comprised of polypropylene.

19. The artificial decorative cake toy of claim 7 wherein said frosting ring is circular-shaped and comprised of aluminum.

20. The artificial decorative cake toy of claim 7 wherein said support tray has a decorative boarder extending around the circumference of said support tray.

21. In an artificial cake toy having a circular-shaped support tray, the tray having a decorative border extending around the circumference of said circular-shaped support tray, the improvement of a circular inverted cup-shaped centerpiece having a diameter smaller than said tray and being mounted upon said tray in an axially centered relationship thereof, said centerpiece having a lower portion and an upper portion, securing means to fixedly mounted said lower portion of said centerpiece on said support tray in mounted integral assembly therein, said upper portion of said centerpiece having a plurality of holes, a layer of circular-shaped colored paper mounted upon said upper portion of said centerpiece such that said colored paper is mounted over said plurality of holes, forming means to mold said colored paper to said centerpiece, said forming means comprising a circular-shaped cake cover having a diameter slightly larger than said centerpiece, said cake cover being positioned over said colored paper and aid centerpiece molding said colored paper to said centerpiece, said forming means also comprising a circular shaped frosting ring having a diameter slightly larger than said centerpiece, after said cake cover has been removed from said centerpiece, said frosting ring being positioned over said colored paper and said centerpiece and mounted on said support tray, securing and anchoring said colored paper to said centerpiece, and a plurality of decorative pieces each having a stem of a corresponding diameter to said holes on said upper portion of said centerpiece, said stems of said decorative pieces being inserted through said colored paper overlying said holes and being fixedly mounted in said holes.

22. The artificial decorative cake toy of claim 21 wherein said securing means used to fixedly mount said lower portion of said centerpiece to said support tray is comprised of a heat sealed polyethylene plastic.

23. The artificial decorative cake toy of claim 21 wherein said securing means used to fixedly mount said lower portion of said centerpiece to said support tray is comprised of a heat sealed polypropylene plastic.

* * * * *